US006961957B2

(12) United States Patent
Carlson

(10) Patent No.: US 6,961,957 B2
(45) Date of Patent: Nov. 8, 2005

(54) ENERGY ABSORBING DEVICE FOR BALLISTIC BODY ARMOR

(75) Inventor: Richard A. Carlson, Yorba Linda, CA (US)

(73) Assignee: Safari Land Ltd., Inc., Ontario, CA (US)

( * ) Notice: Subject to any disclaimer, the term of this patent is extended or adjusted under 35 U.S.C. 154(b) by 189 days.

(21) Appl. No.: 10/438,445

(22) Filed: May 15, 2003

(65) Prior Publication Data

US 2005/0193480 A1 Sep. 8, 2005

Related U.S. Application Data

(60) Provisional application No. 60/462,890, filed on Apr. 15, 2003.

(51) Int. Cl.[7] ..... F41H 1/02
(52) U.S. Cl. ..... 2/2.5; 2/463; 2/464
(58) Field of Search ..... 2/463, 464, 2.5, 2/57, 92, 302, 64; 428/45, 47, 7; 89/36.05

(56) References Cited

U.S. PATENT DOCUMENTS

| | | | | |
|---|---|---|---|---|
| 3,337,875 | A * | 8/1967 | Blakeney | 2/2.5 |
| 3,867,239 | A | 2/1975 | Alesi et al. | |
| 4,412,495 | A | 11/1983 | Sankar | |
| 4,467,476 | A | 8/1984 | Herbert | |
| 4,830,245 | A | 5/1989 | Arakaki | |
| 4,864,656 | A | 9/1989 | Nesse | |
| 4,993,076 | A * | 2/1991 | Dierickx | 2/463 |
| 5,101,511 | A | 4/1992 | Elverskog | |
| 5,534,343 | A | 7/1996 | Landi et al. | |
| 5,584,737 | A | 12/1996 | Luhtala | |
| 5,623,729 | A | 4/1997 | Chen | |
| 5,686,689 | A | 11/1997 | Snedeker et al. | |
| 5,771,489 | A | 6/1998 | Snedeker | |
| 5,878,698 | A * | 3/1999 | Lyell | 119/863 |
| 5,978,961 | A * | 11/1999 | Barker | 2/2.5 |
| 5,996,115 | A | 12/1999 | Mazelsky | |
| 6,009,789 | A | 1/2000 | Lyons | |
| 6,026,510 | A | 2/2000 | Kocher | |
| 6,175,958 | B1 * | 1/2001 | Wu | 2/2.5 |
| 6,332,390 | B1 | 12/2001 | Lyons | |
| 6,418,832 | B1 | 7/2002 | Colvin | |
| 6,500,507 | B1 | 12/2002 | Fisher | |
| 6,786,126 | B2 * | 9/2004 | Sargent | 89/36.02 |
| 2002/0073473 | A1 | 6/2002 | Bachner, Jr. et al. | |
| 2002/0106953 | A1 | 8/2002 | Kim et al. | |

FOREIGN PATENT DOCUMENTS

DE 2344222 6/1974

(Continued)

OTHER PUBLICATIONS

European Search Report, for Application No. EP 03090456., date of mailing Aug. 6, 2004, 4 pages.

(Continued)

*Primary Examiner*—John Calvert
*Assistant Examiner*—Andrew W. Sutton
(74) *Attorney, Agent, or Firm*—Christie, Parker & Hale, LLP

(57) ABSTRACT

A ballistic vest having a front panel and a rear panel attached to each other by releasable connectors. The front and rear panel each have a ballistic package having a plurality of sheets of ballistic material and a semi-rigid frame structure attached to the layers of the ballistic material. The frame structure has a plurality of members defining openings in the frame structure wherein the frame structure absorbs energy from a projectile entering the sheets of ballistic material.

20 Claims, 7 Drawing Sheets

FOREIGN PATENT DOCUMENTS

| | | | |
|---|---|---|---|
| GB | QO5196 | A | 4/1915 |
| GB | 2303534 | A | 2/1997 |
| WO | WO 92/16813 | | 10/1992 |
| WO | WO 00/45118 | | 8/2000 |

OTHER PUBLICATIONS

Abstract modified by the Search Division for Application No. WO 00/45118, 1 page. Reference No. 03090456.9.

* cited by examiner

ENERGY ABSORBING DEVICE FOR BALLISTIC BODY ARMOR

CROSS-REFERENCE TO RELATED APPLICATION(S)

This application claims priority from U.S. Provisional Application No. 60/462,890, filed Apr. 15, 2003.

FIELD OF THE INVENTION

This invention relates to protective vests, and more particularly, to body armor commonly known as a ballistic vest, which incorporates a semi-rigid frame structure attached to the ballistic package.

BACKGROUND OF THE INVENTION

Ballistic vests have saved the lives of many law enforcement officers in recent years. As a result, law enforcement agencies have made it mandatory for their officers to wear a ballistic vest while on duty.

Ballistic vests have been available in recent years as a protective panel having overlying layers of a fabric made from woven high tensile strength fibers. Woven fabrics from an aramid fiber known as Kevlar, for example, have been used successfully in ballistic vests because of the high energy absorption properties of the fabric material. The material is also reasonably light in weight and flexible, which provides improved comfort when compared with previous vests which were made of metal and were therefore heavier and more rigid. The comfort of a ballistic vest is extremely important, especially to law enforcement officers, because of the heat build-up that occurs from wearing a heavy and inflexible vest for the long hours an officer is on duty. Resistance to projectile penetration is a principle factor in designing a ballistic vest; and added protective layers can offer greater protection against projectiles having the higher threat levels, but added protective layers also add undesired weight and inflexibility of the vest.

In addition to woven Kevlar fabric layers, ballistic vests have been made from other high strength fibers and composites to reduce weight and improve flexibility of the vest. However, ballistic vests using the lighter, more flexible materials also must offer the required minimum levels of protection against penetration by different types of projectiles. The more flexible the ballistic fabrics are, the more bunching and backface deformation occurs upon impact from a projectile. A vest must not be too flexible where is cannot protect the wearer.

Ballistic vests are regularly certified by subjecting them to ballistics testing to measure their ability to protect against different projectiles fired from different types of weapons at various angles. One ballistic test commonly used in the industry is the National Institute of Justice (NIJ) Standard 0101.03 Threat Level IIIA, which, in general terms, is a high performance standard requiring that the ballistic vest prevent penetration of specified 0.44 Magnum and 9 mm rounds fired at a velocity of at least 1400 ft/sec. In addition to prevent such projectile penetration, "backface deformation" also is a required test factor in the NIJ Standard 0101.03 Threat Level IIIA certification test. Backface deformation measures the trauma level experienced by a projectile that does not penetrate the test panel. According to this test, the maximum allowable backface signature (bfs) containment for soft body armor requires a maximum allowable bfs of 44 mm for 0.44 Magnum and 9 mm rounds.

There is a need to provide a ballistic vest that is reasonably light in weight, is thin and is comfortable, and is also capable of meeting the high performance projectile specifications of, as an example, the NIJ. Providing such a vest at a reasonably low cost for the comparable high performance level also is a desirable objective.

There are other instances where lighter weight vests are more desirable even though they may not meet the Threat Level IIIA standards. Here the challenge is to produce a lightweight vest capable of meeting the certification standards of NIJ Threat Levels II and IIA. An extremely lightweight vest with an areal weight less than one pound per square foot that meets Level II and IIA standards is desirable.

Such a vest design which meets these requirements is disclosed in applicant's U.S. Pat. No. 5,619,748. The disclosure of which is incorporated herein by reference. The vest of the '748 patent is marketed by Safari Land Ltd., Inc. under the trade name Hyperlite and is a concealable ballistic vest.

A problem associated with currently available concealable soft body armor ballistic vests is that when the vest is shot the ballistic package can twist or ball up potentially exposing areas of the wearer to subsequent rounds. Another continuing problem of existing concealable ballistic vests is that when worn for prolonged periods of time the wearer becomes overheated or because of the flexibility of the ballistic material, the ballistic package can sag forming set wrinkles in the bottom of the carrier.

Consequently, a need exists for an improved concealable vest design which addresses the drawbacks of previous vest designs, namely, to improve ballistic performance and comfort and to reduce weight while simultaneously reducing blunt trauma.

SUMMARY OF THE INVENTION

The present invention provides a ballistic vest of the soft body armor type preferably comprising a plurality of overlying first flexible layers arranged in a stack on a strike side of the vest, and a plurality of overlying second flexible layers arranged in a stack on a body side of the vest. Preferably, each first flexible layer comprises a thin, flexible, woven fabric layer made of high tensile strength polymeric fibers. The individual woven fabric layers form a soft, flexible woven fabric first panel for the vest. Preferably, each second flexible layer comprises a thin, flexible imperforate fiber-reinforced plastic sheet comprising an array of plastic fibers embedded in a thermoplastic resinous matrix that forms each film sheet. The second layers overlie each other and as a combination are referred to as a second panel of the vest. The first and second panels are both located in the front and rear of the vest. Although this is a preferred ballistics package, any type and number of ballistic packages which meet any threat level are contemplated for use in the present invention. The vest of the present invention preferably is designed to be concealable, however it is to be understood that the inventive concepts are equally applicable to ballistic vests which are worn on the outside of the wearers' clothing or uniforms. The ballistic package of the present invention is equally applicable to other types of protective garments other than vests.

The ballistic vest of the present invention incorporates nylon hook fasteners with rounded ends to fasten the front panel to the back panel, and are attached to stretch neoprene strapping or conventional elastic. Vests, or other garments of the present invention can also use buckles, zippers and other fastening systems.

More particularly, the ballistic vest of the present invention incorporates a frame system made of low density plastic, composite or other semi-rigid materials which is attached to the ballistic package to improve safety and performance of the vest. The frame system is directly attached to the ballistic fabric material of a ballistic package in the vest. The frame system distributes energy across the surface of the ballistic package, thus reducing trauma to the wearer and also improving ballistic performance of the package. The frame system permits the production of lower cost and lighter weight ballistic vests. The frame system offers resistance to the amount of the ballistic package travel and material twist into the center of the area of impact. The frame system thereby reduces the amount of depression or backface trauma caused by stopping the projectile. Consequently, injury caused by blunt force trauma is reduced, thereby improving safety of the vest. Because the frame system reduces the amount of material travel, the amount of ballistic materials can be reduced, thereby providing an effective ballistic system which is lighter in weight and thickness, which improves wearer comfort and reduces the overall cost for manufacturing the vest. The frame structure increases the V-50 performance of current ballistic panel configurations.

Preferably the frame structure is sewn on top of or in between the multiple plies of ballistic fabric contained within a ballistics package. The frame supports the ballistic fabrics and acts to distribute energy in a ballistic event. The frame structure is cut in a geometric form with open areas dispersed throughout the frame structure. The exact size, shape and thickness of the open areas will vary based upon the size of the ballistics panel or other factors related to each ballistic fabric or type of projectile that the ballistic vest is designed to stop. The multiple plies of ballistic material to which the frame structure is attached can consist of woven or non-woven Kevlar, Spectra, Nylon or Zylon fibers, or other known ballistic materials. Typically, the frame structure is positioned on the strike face side of the vest with not more than 50% of the ballistic fabric plies in front of the frame structure. Because the frame is semi-rigid, it prevents the ballistic package from sagging and allows the vest to be worn in a loose condition, thereby reducing heat build-up and improving wearer comfort.

In a ballistic event, the projectile strikes the ballistic materials and energy is transferred to the frame structure via the fibers in the ballistic fabrics. When the bullet contacts the surface, it expands, twists and becomes entangled in the fibers, and tension is put on the fibers stretched between the frame structure of the ballistic vest. As the fabric bunches around the bullet, the frame structure is loaded. The frame structure being flexible offers resistance to the amount of the ballistic material travel and twist into the center area of impact. The frame structure thereby reduces the amount of depression of backface trauma caused by the slowing projectile. The frame structure, by supporting the ballistic fabric, reduces the chance of the panel bunching or moving after a ballistic event.

BRIEF DESCRIPTION OF THE DRAWINGS

These and other features and advantages of the present invention will be more fully understood by reference to the drawings and following detailed description wherein.

DETAILED DESCRIPTION OF THE INVENTION

Figure 1:
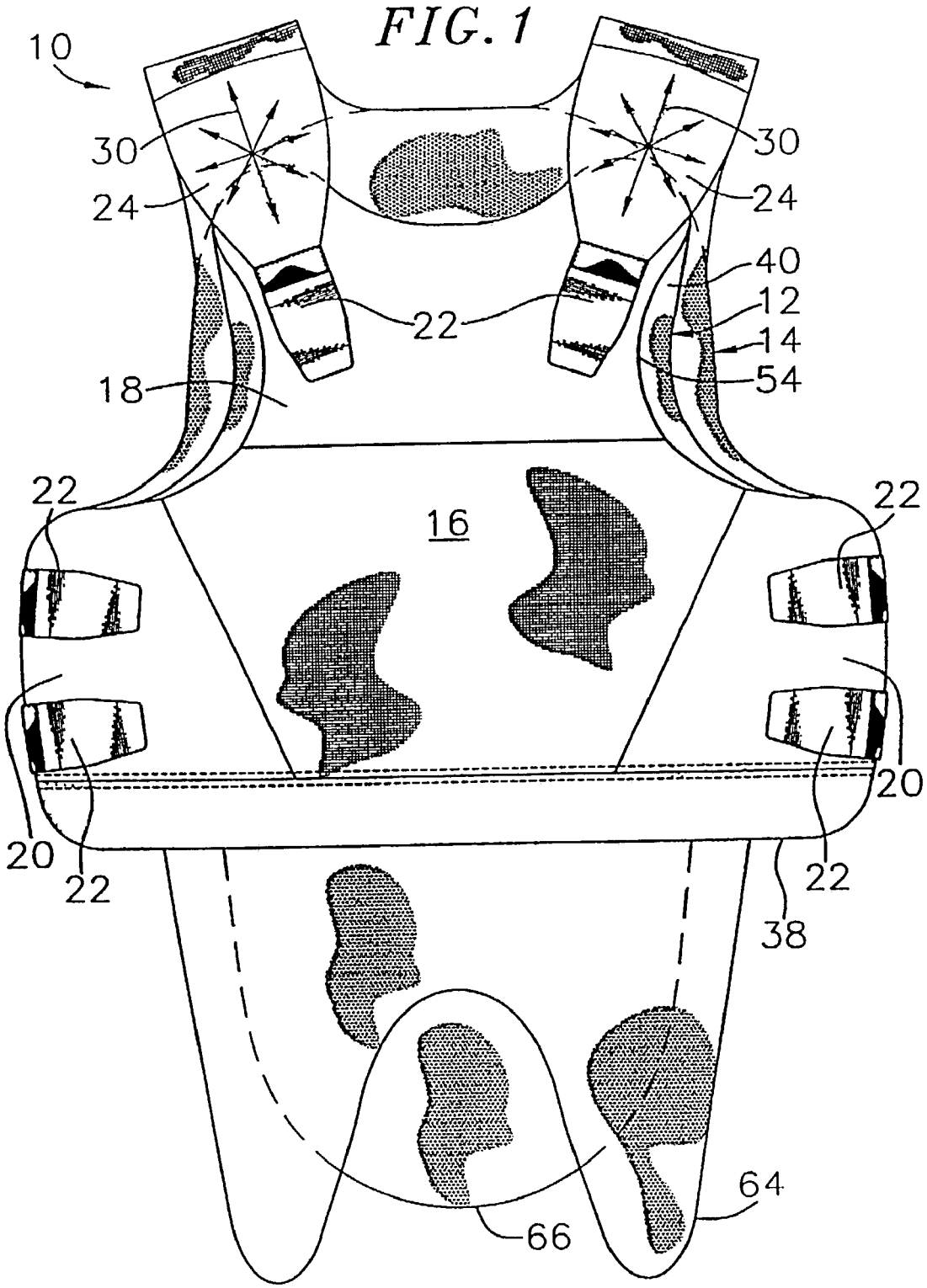
FIG. 1 is a front view of a ballistic vest of the present invention.
Figure 2:
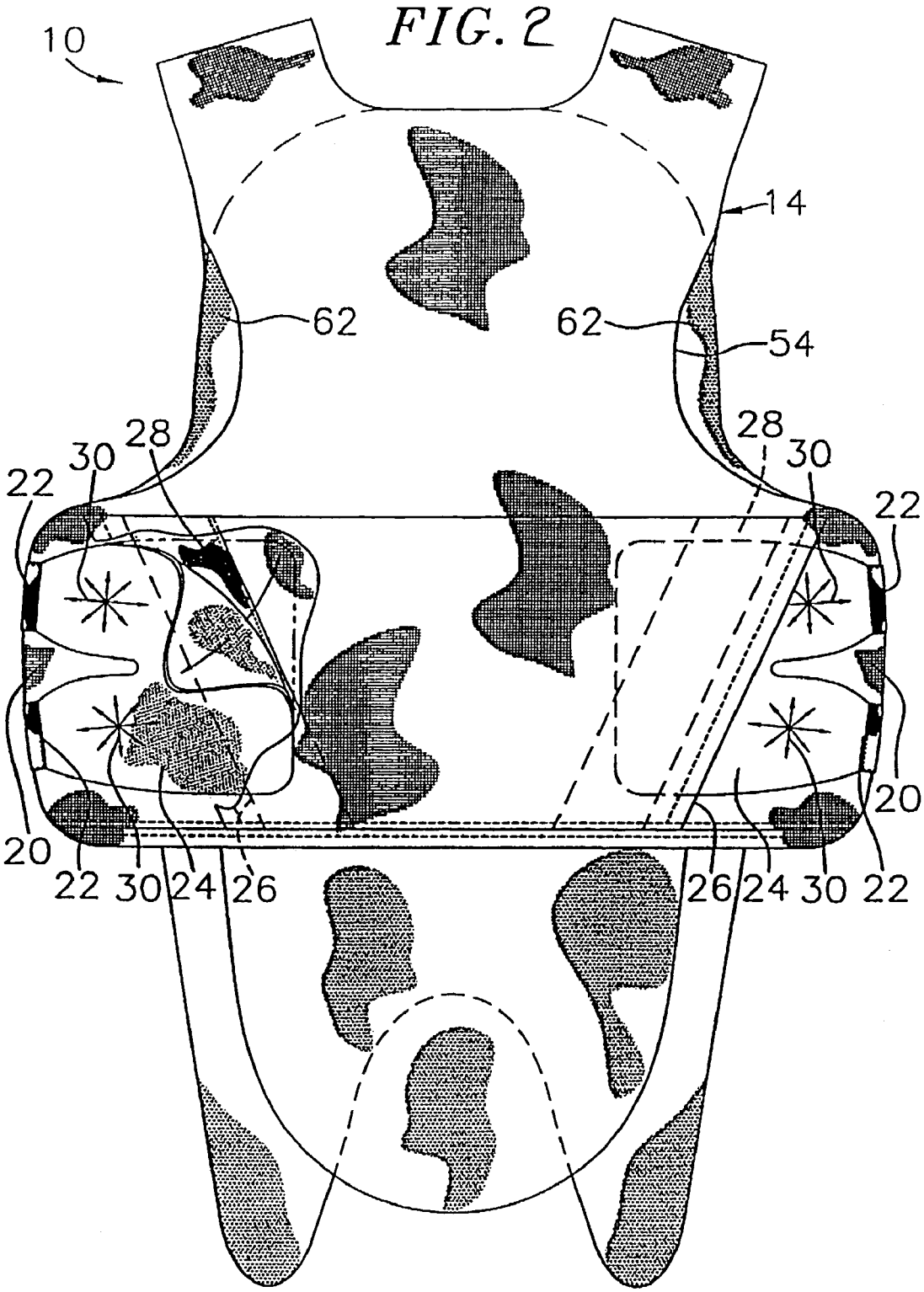
FIG. 2 is a back view of the ballistic vest of FIG. 1.

A ballistic vest 10 of the present invention is shown in FIGS. 1 and 2. The ballistic vest 10 is a concealable vest of the soft body armor type commonly worn by law enforcement officers. The ballistic vest includes a front panel 12 and a rear panel 14. The front panel 12 protects the chest and stomach of the wearer while the rear panel 14 protects the back of the wearer. Both the front and rear panels protect the sides of the wearer as will be discussed in more detail below.

The front panel 12 may include a trapezoidal center panel 16 and hook compatible fabric located along the top 18 and sides 20 of the front panel 12. Top 18 and sides 20 provide a large area for hook fasteners 22 to secure the front panel and rear panel together around the wearer. Top 18 and sides 20 allow for placement of fasteners 22 at any location to provide an optimal fit for the particular wearer. Neoprene composite straps 24 located at the top and sides of the ballistic vest are attached to the fasteners 22 to secure the front and rear panels together. As seen best in FIG. 2, straps 24 for connecting the top of the front and rear panels can be typically sewn to the rear panel and or as with straps 24 located at the sides of the ballistic vest, can be inserted into a pocket 26 which includes a section of hook fasteners 28 sewn within a pocket for connection of the neoprene straps 24. The pocket arrangement for the straps 24 can be located at the top, sides or both locations of the vest. As indicated by the direction arrows 30 the neoprene straps 24 provide for multi-directional adjustment of the straps. In addition, the straps can be formed with a contoured surface to provide for additional comfort of the straps. The strapping 24 is a laminated neoprene and Nylon composite which provides more adaptability and freedom of movement. The neoprene composite is commercially produced by Rubatex of Santa Fe Springs, Calif. Alternatively, Nylon can be used for the straps.

Figure 3:
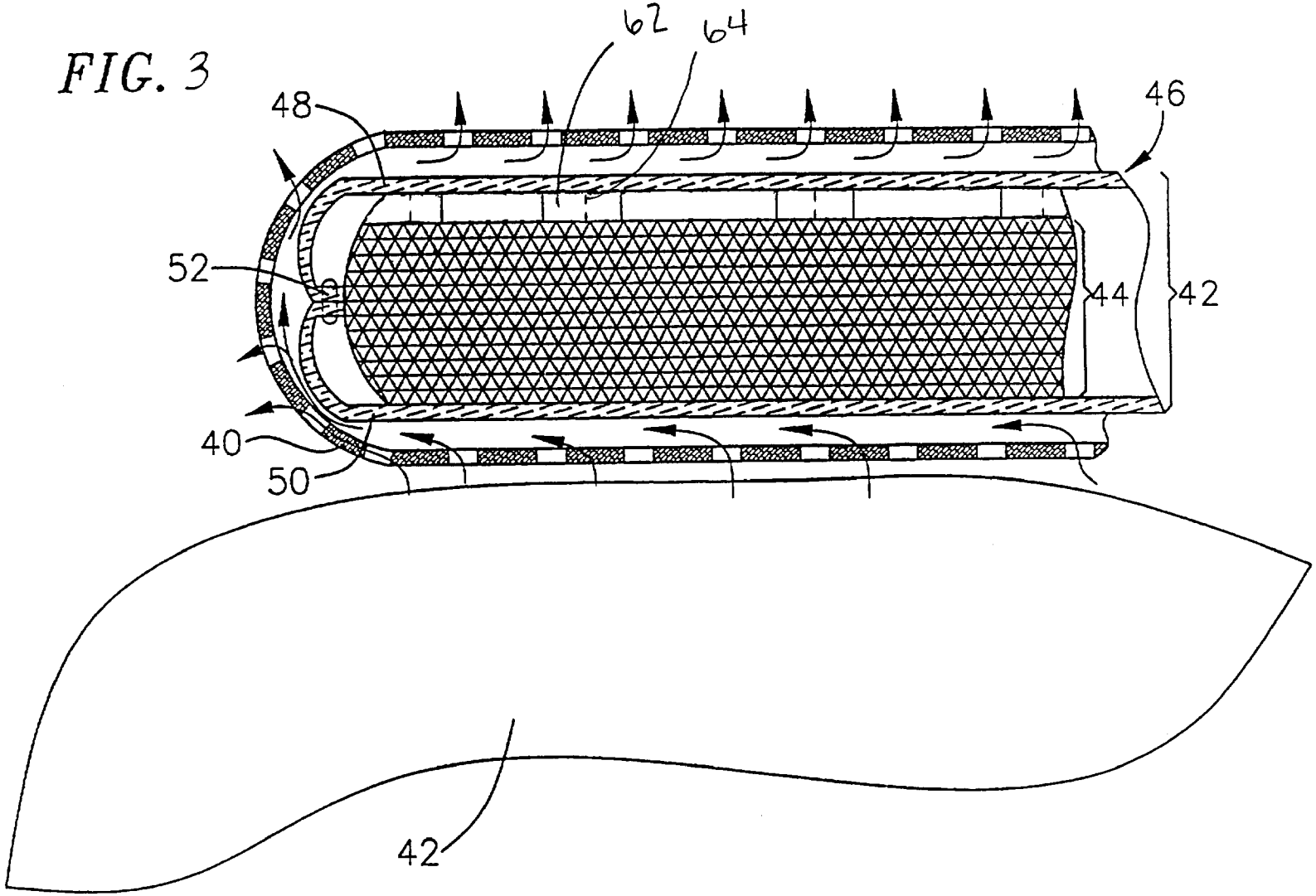
FIG. 3 is a partial cross-sectional view of the front panel of the ballistic vest of the present invention.

As shown in FIG. 3, the front panel, as well as the rear panel, includes a lining material 40 which is adjacent the body 42 of the wearer and extends around the edge of the panel to the outside of the ballistic vest. The material can be perforated or of solid construction and is a moisture absorbing material which wicks moisture away from the body and around to the outside of the vest for evaporation. Body moisture is transferred to provide an evaporative cooling effect. The preferred moisture-absorbing material is an anti-microbial material commercially available under the trade name Microsafe by Rentex, Inc. of Montreal, Canada. Contained within the lining material 40 is the ballistic panel 42 which comprises the individual layers of ballistic material 44 located within a covering layer 46. Layer 46 comprises a top layer 48 and a bottom layer 50 stitched together at internal seam 52. Gaps are shown in FIG. 8 between lining material 40 and top and bottom layers 48 and 50, and between layers 48 and 50 and ballistic material 44 only so that these components can be easily illustrated. It is to be understood that in the actual vest no gaps are present so that ballistic protection extends virtually from edge to edge in the front and rear panels.

As shown in FIGS. 1 and 2, the lining material 40 extends around to the outside surface of the vest and is sewn to the outside surface of the front and rear panels 18 and 20 to form a seam 54 which allows the ballistics package to extend all the way to the edge of the front and rear panels. As a result, the ballistics package provides more protective surfaces and thus a more protective body armor is created.

Figure 4:
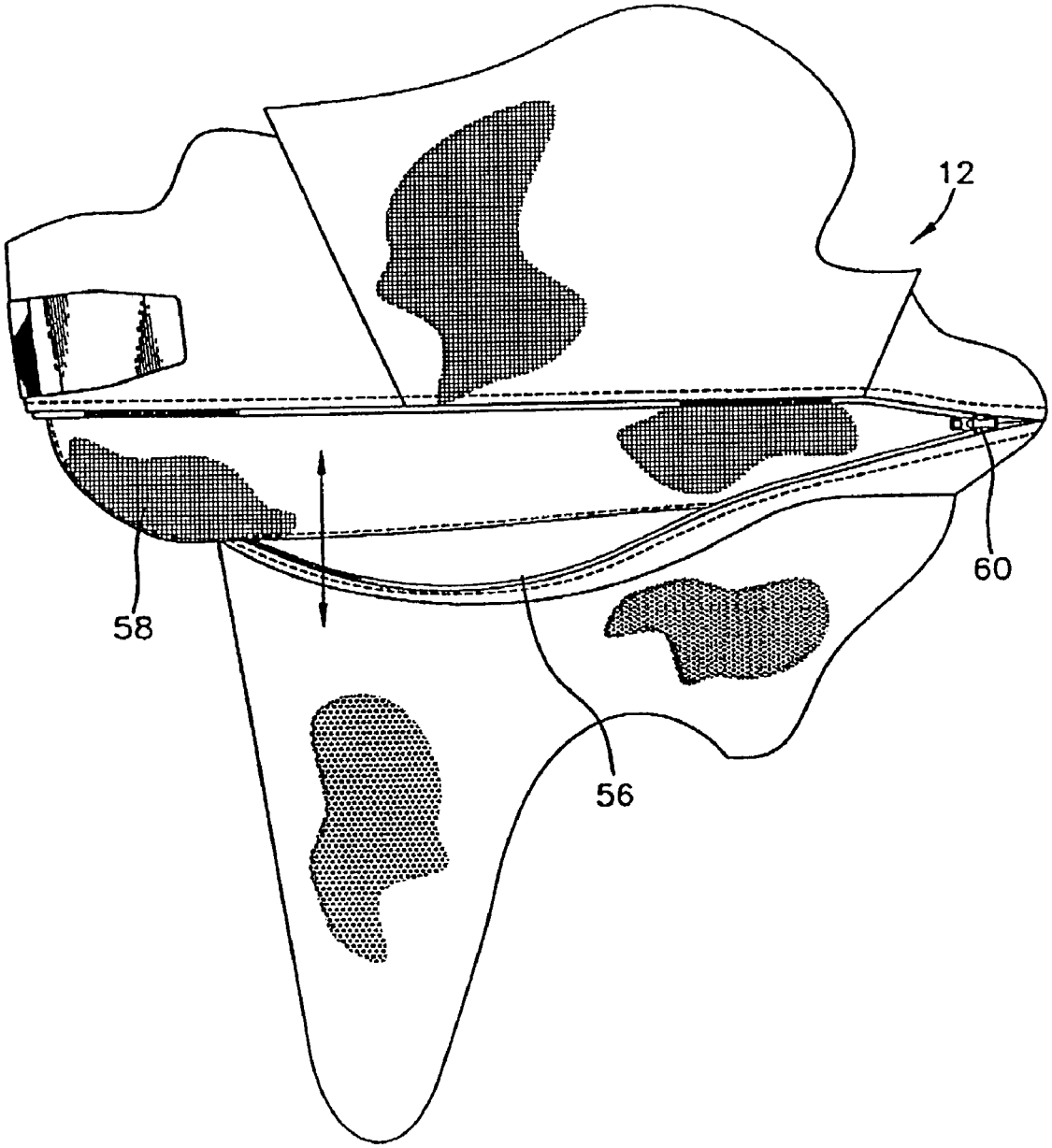
FIG. 4 is a detail of FIG. 1 illustrating the access to the ballistics penal or package.

As shown in FIG. 4, the front panel 12 includes an opening 56 for access to the ballistics panel 58. The opening is positioned on the outside of the front panel to produce a smooth surface against the body. A zipper 60 or other suitable closing mechanism extends across the width of the opening. The zipper permits easy access to remove the ballistic panel or package.

As seen in FIG. 2, the ballistic vest includes visual inspection ports 62 positioned on the exterior of the garment. In FIG. 2, the visual inspection ports are located on the outside surface of the back panel. Inspection ports allows the wearer to see that the ballistic package or panel is in place without opening the garment, thus improving the level of safety. The visual inspection ports are two mesh windows, or other suitable window material by which the ballistic panel can be viewed.

As shown in FIG. 1, retention tails 64 and 66 are sewn to the lower edge 38 of the front and rear panels respectively. Preferably the tails are constructed of stretchable fabrics or meshes which are tucked into a wearers trousers to hold the vest down during movement. Considering the fabric is made of a stretchable material, the tails improve freedom of movement while holding the vest in place when sitting or standing.

Figure 5:
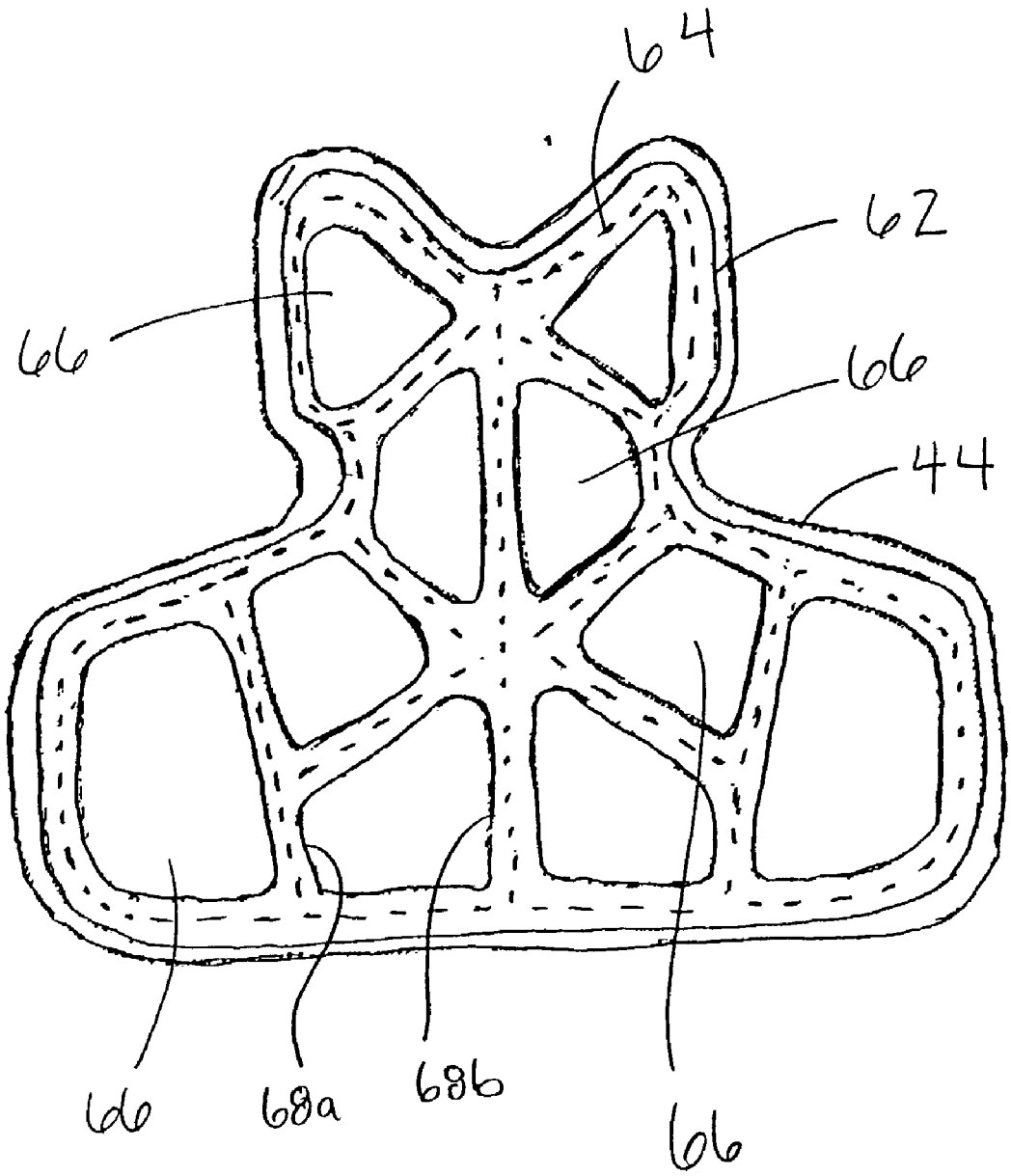
FIG. 5 is a front view of the ballistic package or panel incorporating a semi-rigid frame.
Figure 6A:
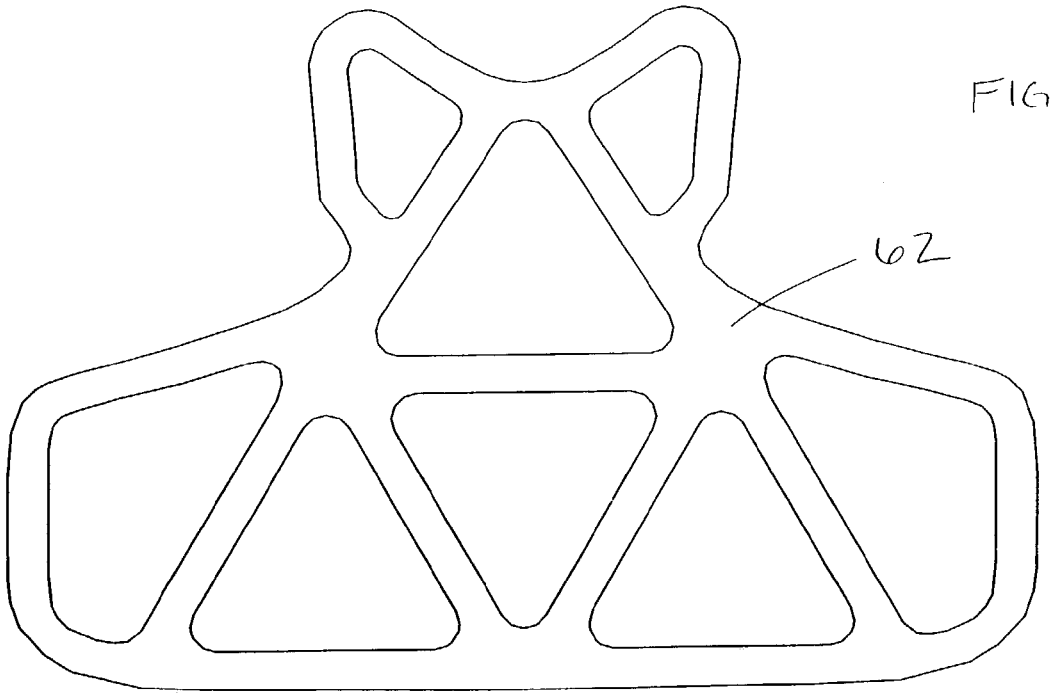
FIGS. 6A–6D are front views of alternative configuration frame designs.
Figure 6B:
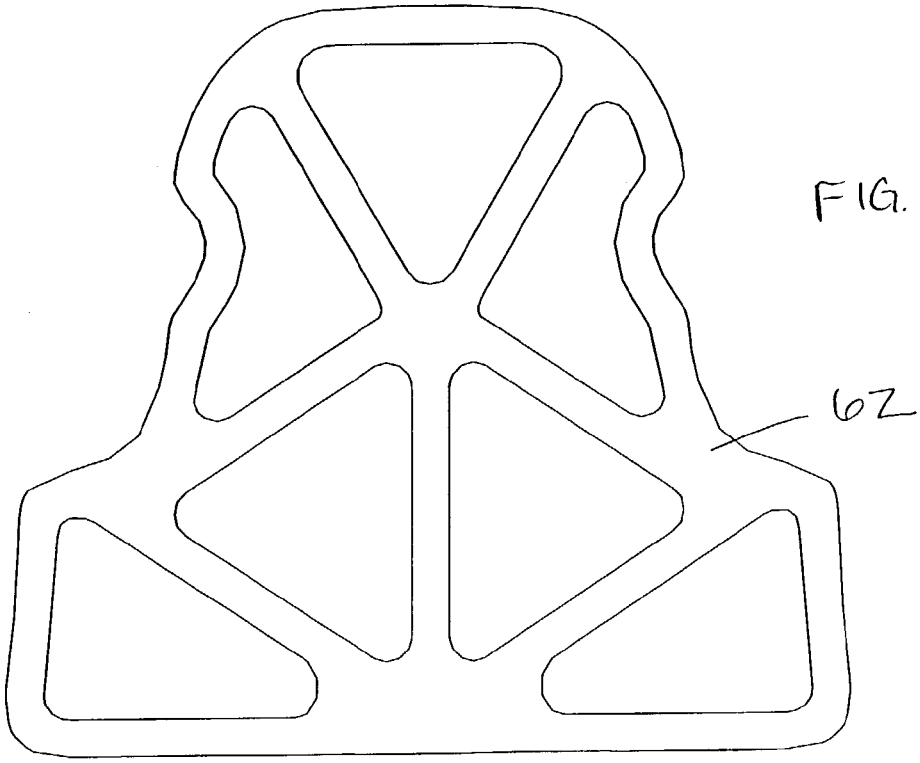
Figure 6C:
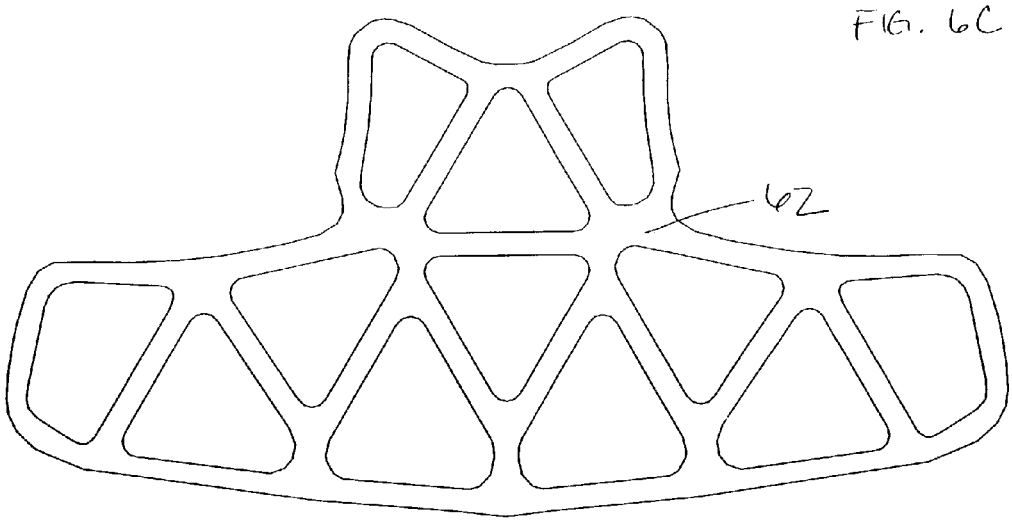
Figure 6D:
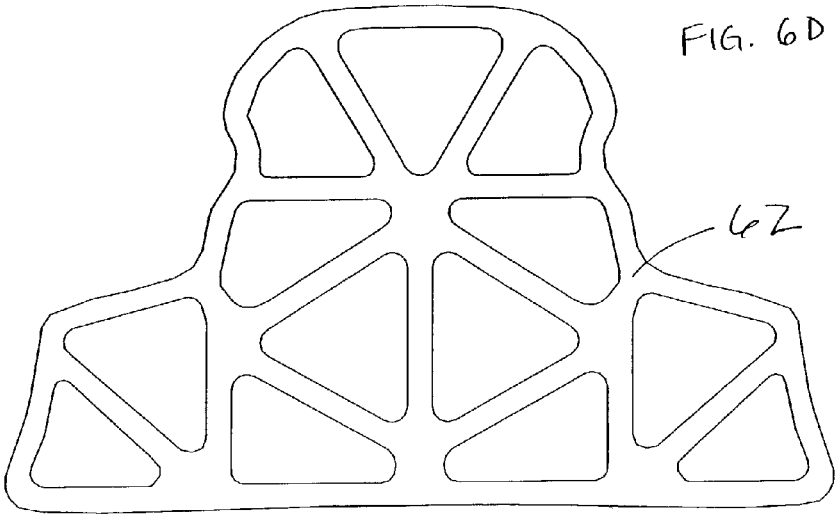

As shown in FIGS. 3, 5 and 6A–D, the ballistic vest of the present invention includes a frame 62 attached to the layers of ballistic material 44. The frame is skeletal in that it forms a structural framework for the ballistic material. The frame is made of low density plastic, composite or other semi-rigid materials which is attached to the ballistic fabric layers 44 by Kevlar stitching 64. Other methods of attaching the frame to the ballistic material are contemplated by the invention, such as by gluing or laminating the frame to the materials. The frame distributes energy across the surface of the ballistic panel, thereby reducing trauma to the wearer while improving ballistic performance. Although FIGS. 3 and 5 illustrate the frame being attached on the surface of the ballistic materials, it is to be understood that the frame can be positioned within the multiple plies of ballistic fabric. Considering the frame is made of a semi-rigid material, the frame supports the ballistic fabric and acts to distribute energy in a ballistic event. More specifically, the frame can be cut from a piece of flexible polyethylene plastic sheet or other flexible plastic or composite. The frame can be between 0.010 and 0.090 inches thick and is cut in a geometric form with a plurality of openings 66 dispersed across the surface of the frame. The exact size, shape and thickness of the openings can vary based upon the size of the ballistic panel or other factors related to the specific ballistic fabric or the type of threat level that the armor is required to meet. FIGS. 6A–D are examples of different frame designs. The ballistic material can consist of woven or non-woven Kevlar, Spectra, Nylon or Zylon fibers, or any other commercially available ballistic materials. For example, the frame will be used on soft body ballistic panels weighing less than 1.59 pounds per square foot and more particularly for panels weighing less than 0.50 pounds per square foot. The frame 62 is located on the strike face side of the ballistic vest and when located between the plies be positioned such that not more than 50% of the ballistic fabric plies will be on top of the frame.

The frame controls blunt trauma and reduces the amount of ballistic materials required to construct an effective ballistic vest, which can reduce cost, weight and thickness, thereby producing lighter and thinner ballistic vests, which also improves wearer comfort. Tests have shown that the frame can keep the projectile on the surface of the ballistic package.

In a ballistic event, the projectile strikes the ballistic materials and energy is transferred to the frame via the fibers in the ballistic fabric. When a bullet contacts the surface, it expands and becomes entangled in the fibers, and tension is put on the fibers stretched between the individual members, for example, 68A and 68B. As the ballistic material bunches around the projectile, the frame is loaded. The flexible frame offers resistance to the amount of material travel and twist into the center of the area of impact. This condition thereby reduces the amount of depression or backface trauma caused by the slowing projectile. In addition to supporting the ballistic material, the frame reduces the chance that the ballistic panel will bunch or move after a ballistic event.

VO and V50 testing was performed for ballistic packages incorporating a frame as disclosed herein with the results being well within NIJ standards. The ballistic packages weighed 0.39, 0.49 and 0.59 pounds per square foot and the frames were either 0.0060 or 0.0030 inches thick. 357 magnum and 9 mm projectiles were utilized.

Although the present invention has been shown and illustrated with respect to an embodiment thereof, the invention is not to be so limited since changes and modifications can be made therein which are within the scope of the invention as hereinafter claimed.

What is claimed is:

1. A ballistic panel for use in a ballistic vest comprising:

a plurality of layers of ballistic material; and a semi-rigid skeletal frame rigidly attached to the layers of ballistic material.

2. The panel of claim 1 wherein the frame includes a plurality of members defining a plurality of openings in the frame.

3. The panel of claim 1 wherein the frame is sewn to the ballistic material.

4. The panel of claim 1 wherein the frame is glued to the ballistic material.

5. The panel of claim 1 wherein the frame is plastic.

6. The panel of claim 5 wherein the frame is polyethylene.

7. The panel of claim 1 wherein the frame is attached to a top surface of the ballistic material.

8. The panel of claim 1 wherein the frame is embedded within the layers of ballistic material.

9. The panel of claim 8 wherein less than 50% of the layers of the ballistic material is on top of the frame.

10. A ballistic vest comprising:

a front panel;

a rear panel;

the front and rear panels each having a ballistic package comprising a plurality of layers of ballistic material and a semi-rigid skeletal frame attached to the layers of ballistic materials; and connectors for attaching the front and rear panels together.

11. The vest of claim 10 wherein the frame includes a plurality of members defining a plurality of openings in the frame structure.

12. The vest of claim 10 wherein the frame is sewn to the ballistic material.

13. The best of claim 10 wherein the frame is glued to the ballistic material.

14. The vest of claim 10 wherein the frame is plastic.

15. The vest of claim 14 wherein the frame is polyethylene.

16. The vest of claim 10 wherein the frame is attached to a top surface of the layers of ballistic material.

17. The vest of claim 10 wherein the frame is embedded within the layers of ballistic material.

18. The vest of claim 17 wherein less than 50% of the layers is on top of the frame.

19. The vest of claim 10 wherein the front and rear panels have a carrier in which the ballistic package is positioned.

20. A ballistic vest having a front and rear panel each having a ballistic package comprising a plurality of sheets of ballistic material and means attached to the sheets for absorbing energy of a projectile entering the sheets of ballistic material.

* * * * *

UNITED STATES PATENT AND TRADEMARK OFFICE

CERTIFICATE OF CORRECTION

PATENT NO. : 6,961,957 B2
DATED : November 8, 2005
INVENTOR(S) : Carlson

It is certified that error appears in the above-identified patent and that said Letters Patent is hereby corrected as shown below:

Column 8,
Line 9, after "material" insert -- , wherein the means is a semi-rigid skeletal frame having a plurality of members defining openings in the frame --.

Signed and Sealed this

Twenty-fifth Day of April, 2006

JON W. DUDAS
*Director of the United States Patent and Trademark Office*